United States Patent [19]

Clark

[11] Patent Number: 5,069,090

[45] Date of Patent: Dec. 3, 1991

[54] MULTI-PURPOSE CONTAINER OPENING TOOL

[76] Inventor: Ronald M. Clark, 105 Factory, Addison, Ill. 60101

[21] Appl. No.: 486,355

[22] Filed: Feb. 26, 1990

[51] Int. Cl.[5] ..... B67B 7/44

[52] U.S. Cl. ..... 81/3.09; 81/3.55; 7/105; 7/151

[58] Field of Search ..... 81/3.07, 3.09, 3.55, 81/3.57; 7/151, 105; D8/18, 33, 34, 40

[56] References Cited

U.S. PATENT DOCUMENTS

| | | | |
|---|---|---|---|
| D. 263,673 | 4/1982 | Sheehan | D8/18 |
| D. 276,304 | 11/1984 | DiFede | 81/3.55 |
| D. 304,992 | 12/1989 | Matthies | D8/40 |
| 4,658,455 | 4/1987 | Skillern | 7/151 |

*Primary Examiner*—Roscoe V. Parker

*Attorney, Agent, or Firm*—Robert F. Van Epps

[57] ABSTRACT

A multi-purpose tool for opening a variety of pail or bucket types of containers and having a handle portion from which a claw-type opener extends from one end and optionally a plurality of projections adapted for opening particular types of containers extend from the opposite end.

3 Claims, 1 Drawing Sheet

MULTI-PURPOSE CONTAINER OPENING TOOL

BACKGROUND OF THE INVENTION

1. Field of the Invention

The present invention relates generally to the field of hand tools and more specifically to a multi-purpose tool for opening a variety of pail or bucket type containers having various closure arrangements.

2. Description of the Prior Art

A wide variety of residential as well as commercial-/industrial products are packaged in various types of pail or bucket type containers. By way of examples, paint is typically packaged in metal can shaving a friction-fit tongue and groove closure. Products used in relatively larger quantities such as roofing materials and various sealants come in larger metal bucket shaving a lid which is secured by a plurality of metal tangs which are crimped around the top of the bucket. A number of products are supplied in plastic buckets having a circumferential ridge proximate the top edge and lid tapered at its circumference such as to engage the ridge and seal the bucket. In each case it is necessary to remove the lid in such a fashion to permit it to be replaced.

Prior to the present invention a variety of single purpose tools adapted for use with specific types of containers have been known, mainly large five gallon type plastic buckets. They do not make accommodations for removing the lids from one gallon plastic pails or metal buckets and cans. U.S. Pat. No. 4,658,455 which issued on Apr. 21, 1987 to Skillern describes a claw-type tool for opening wide-lipped buckets and having a scraper blade imbedded in the front of the tool. In actual use of the Skillern tool, the applicant has found that the claw removes lids from large five gallon buckets, but is shaped as such that it will not engage the lid of the newer one gallon plastic pails; thus, rendering it useful to only limited applications. Particularly, when used to open plastic containers, if the tool rocks too far forward or slips off the lid, the scraper blade can puncture the lid thus rendering it useless to protect any remaining contents of the container. Further, if the scraper blade is sufficiently wide at its forward end to function properly as a scraper, it becomes unsuitable to remove safely the friction-fit lids from smaller cans.

U.S. Pat. No. Des. 304,992 which issued on Dec. 12, 1989 to Matthies also shows a claw type tool. In actual use of the Matthies tool the applicant has found that the claw extends too far beneath the edge of the lid of certain plastic buckets and pails and thus tends to hang up on the circumferential ridge and interferes with the use of the tool and the removal of the lid since it engages the bucket, not the lid.

OBJECTS AND SUMMARY OF THE INVENTION

From the preceding discussion it will be understood that among the objectives of the present invention are included the following:

the provision of a new and improved multi-purpose container opening tool;

the provision of a tool of the above-described character useful to remove a variety of container lids safely and without substantial damage to the lid or container; and the provision of a tool of the above-described character which is simple and economical to manufacture.

These and other objectives of the present invention are efficiently achieved by providing a handle portion from a first or forward end of which extends a claw opener adapted for use with plastic containers having lids which extend over the edge of the container. From opposite sides of the other end of the handle extend two projections; the first adapted for use in opening friction-fit can lids and the second for releasing crimped tang type lids.

The foregoing as well as other objects, features and advantages of the present invention will become more apparent from the following detailed description taken in conjunction with the appended drawing.

DESCRIPTION OF THE PREFERRED EMBODIMENT

Figure 1:
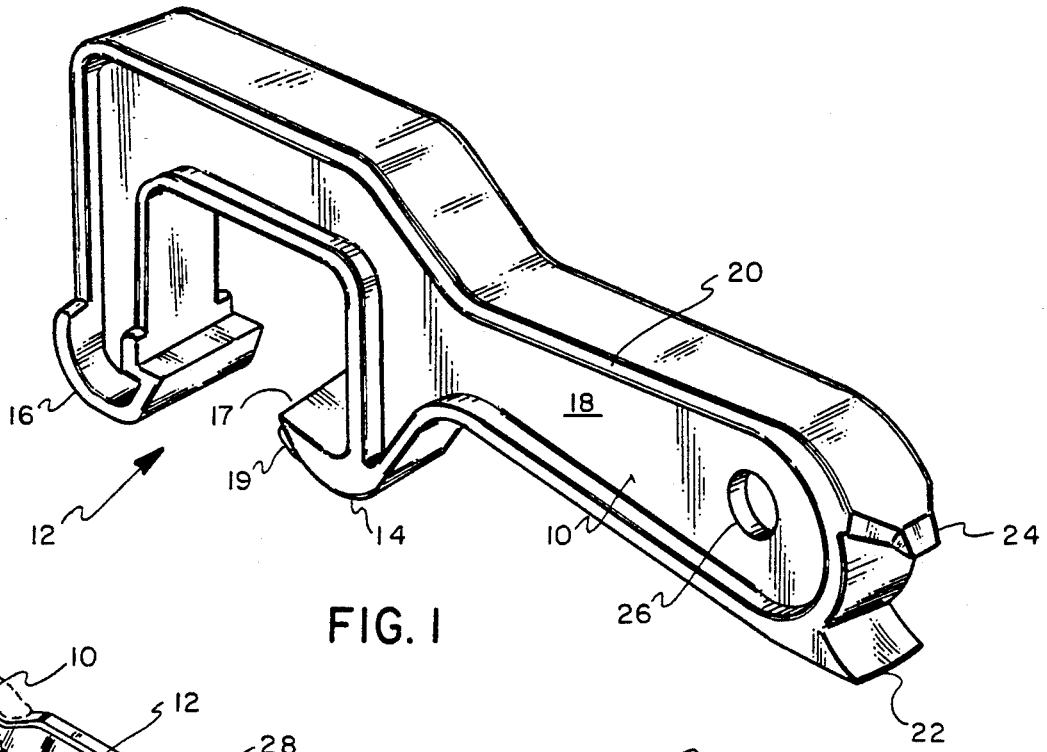
FIG. 1 is a perspective view of a multi-purpose container opening tool in accordance with the principles of the present invention.
Figure 2:
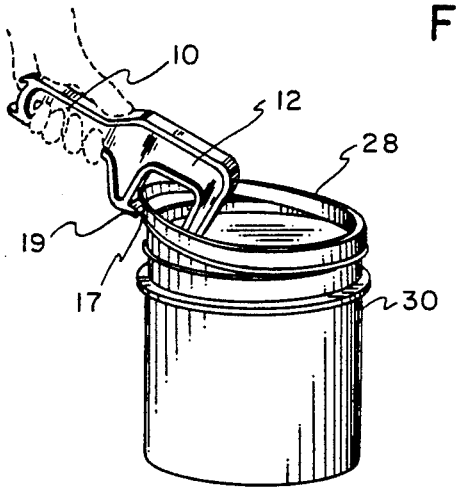
FIG. 2 is a perspective view showing the tool of the invention being used to pry a lid from a container.

With reference now to the drawing there is shown a hand tool having a handle portion 10 from one end of which extends a claw opener 12 principally for use in opening plastic containers of the type having a first ridge 27 which the lid 28 engages and second circumferential reinforcing ridge 20. The rear projection 14 of the claw 12 is adapted to engage the container lid 28 and the downwardly projecting forward end 16 engages the top of the lid. A lid engaging flange 17 extends forwardly only by an amount sufficient to engage the container lid 28 without coming into contact with the side of the container itself. The flange 17 is provided at its lower surface with a transverse shoulder 19 which bears against the second circumferential reinforcing ridge 29 on the container to thereby prevent the flange 17 from hanging up on the first ridge 27 on the container 30. Thus by pulling upwardly on the handle 10 the lid 28 is pried from the container 30 as illustrated in FIG. 2. The absence of any sharp elements on the forward end of the tool minimizes the potential for any damage to the top of the lid.

In order to conserve materials used in the manufacture it is preferred that the handle and claw portions 10 and 12 respectively of the tool be of a selected first thickness with a reinforcing ridge 20 disposed about the periphery throughout its length. The tool may be formed of various materials including plastics or metal and could be cast, molded or machined depending upon the economics of manufacture.

Figure 3:
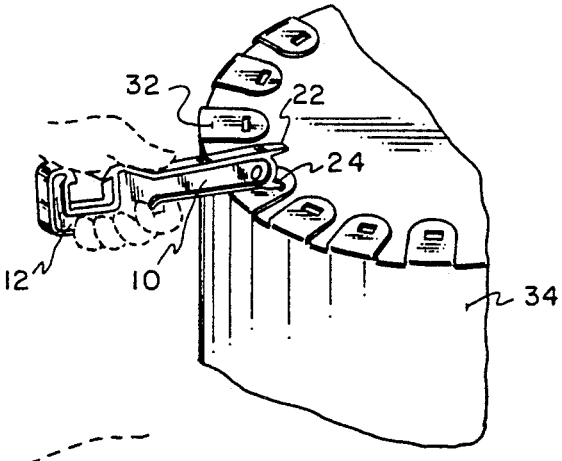
FIG. 3 is a perspective view showing the tool of the invention being used to lift a lid tang away from the top of a container.
Figure 4:
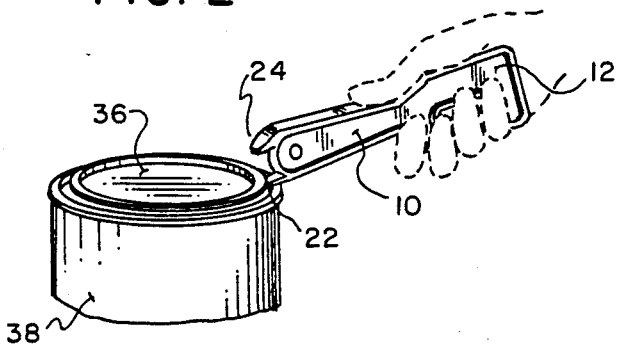
FIG. 4 is a perspective view of the tool of the invention being used to remove a friction fit type lid from a container.

The rearward portion of the handle 10 is provided with first and second projections 22 and 24 respectively. The projections 22 and 24 extend from the rearward portion of the handle 10 such as not to interfere with the claw portion in removing plastic lids and further for the purpose of user safety such that they are behind the user's hand when gripping the tool. Projection 24 is tapered from the width of the handle 10 to a dimension which will conveniently fit the tang of a crimped metal cover, typically about five-sixteenths inch. It is curved or angled in a longitudinal arc from the handle 10 such as to slide easily under the top bead portion of the lid and provide a fulcrum effect as the tool is pulled upward thus lifting the lid tang 32 away from the top of the container 34 as shown in FIG. 3. The projection 22 is curved or angled somewhat inwardly for safety reasons but less so than projection 24 and is substantially the width of the tool handle 10. This projection 22 is adapted to engage and remove the friction fit type lids 36 typically found on smaller metal cans 38 as shown in FIG. 4. A hole 26 may be provided at any convenient location in the body of the tool to facilitate hanging.

From the foregoing it will be understood that the applicant has provided a simple and economical multipurpose container opening tool whereby the objectives set forth herein are efficiently achieved. Since certain changes in the above-described construction will occur to those skilled in the art without departure from the scope of the invention, it is intended that all matter contained in the above-description or shown in the appended drawing shall be interpreted as illustrative and not in a limiting sense.

Having described what is new and novel and desired to secure by Letters Patent, what is claimed is:

1. A tool for removing lids from containers, said tool comprising a handle portion;

a claw opener portion extending from a first end of said handle portion;

said handle and claw opener portions being of a selected first thickness and having a reinforcing ridge disposed about the periphery thereof; and said claw opener having a flange adapted to engage the lid of a container and being provided at its lower surface with a transverse shoulder operative to prevent said flange from engaging said container.

2. The tool as set forth in claim 1 further including a projection extending longitudinally from the end of said handle portion and of a width substantially equal to that of said reinforcing ridge of said handle portion adapted to remove friction fit type container lids.

3. The tool as set forth in claim 1 further including a projection extending longitudinally from the end of said handle portion being laterally tapered from a width substantially equal to that of said reinforcing ridge of said handle portion to a selected lesser thickness adapted to remove crimped tang type covers.

* * * * *